US005779445A

United States Patent [19]

Yokota et al.

[11] Patent Number: 5,779,445

[45] Date of Patent: *Jul. 14, 1998

[54] NONCONTAMINATIVE CENTRIFUGAL PUMP

[75] Inventors: Hiroshi Yokota; Tetsuya Tanimoto; Masahiro Kawamoto, all of Hiroshima, Japan

[73] Assignee: Kabushiki Kaisha Yokota Seisakusho, Hiroshima-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 615,210

[22] PCT Filed: Sep. 12, 1994

[86] PCT No.: PCT/JP94/01503

§ 371 Date: May 17, 1996

§ 102(e) Date: May 17, 1996

[87] PCT Pub. No.: WO95/08063

PCT Pub. Date: Mar. 23, 1995

[30] Foreign Application Priority Data

Sep. 13, 1993 [JP] Japan ..... 5-226950

[51] Int. Cl.[6] ..... F04D 29/10

[52] U.S. Cl. ..... 415/230; 415/231; 415/174.2

[58] Field of Search ..... 415/106, 113, 415/229, 230, 231, 170.1, 174.2

[56] References Cited

U.S. PATENT DOCUMENTS

| | | | |
|---|---|---|---|
| 963,593 | 7/1910 | Legros | 415/106 |
| 1,967,316 | 7/1934 | Meeker | 415/106 |
| 3,652,180 | 3/1972 | Choquette et al. | 415/113 |

FOREIGN PATENT DOCUMENTS

| | | | |
|---|---|---|---|
| 2355252 | 6/1974 | Germany | 415/113 |
| 16618 | 7/1969 | Japan | 415/113 |
| 123654 | 3/1919 | United Kingdom | 415/113 |
| 896482 | 9/1958 | United Kingdom | 415/113 |

*Primary Examiner*—John T. Kwon
*Attorney, Agent, or Firm*—Ladas & Parry

[57] ABSTRACT

The present invention relates to a noncontaminative centrifugal pump for pumping a high-purity liquid, such as a high-purity chemical or ultrapure water used in a VLSI circuit manufacturing system, without producing any trace of dust and without allowing foreign matters entering its casing. A noncontact shaft seal assembly provides an accurate gap between the rotating and fixed rings thereof to allow a required leakage from the noncontaminative centrifugal pump, does not produce dust by abrasion, inhibits foreign matters from entering the noncontaminative centrifugal pump and maintains the high-purity liquid in a high-purity condition. While the noncontaminative centrifugal pump is in operation, the impeller produces a hydraulic axial thrust to bias the main shaft in one direction by a distance equal to a play thereof so that the gap is maintained in a set size suitable for preventing generation of dust by abrasion and inhibiting foreign matters from entering the casing. The position of the fixed ring of the shaft seal assembly can be adjusted from outside to adjust the gap to a size suitable for maintaining an optimum leakage while the noncontaminative centrifugal pump is in operation. The noncontaminative centrifugal pump facilitates work for inspection and maintenance and is suitable for pumping a high-purity liquid.

16 Claims, 2 Drawing Sheets

NONCONTAMINATIVE CENTRIFUGAL PUMP

TECHNICAL FIELD

The present invention relates to a pump for pumping a high-purity liquid, such as a high-purity chemical or ultrapure water used in a VLSI (very large scale integrated) circuit manufacturing system, without internally producing any trace of dust and, more specifically, to a noncontaminative centrifugal pump provided with a noncontact shaft seal assembly providing an accurate gap to allow a required leakage from the associated system, and having a structure that does not produce dust by abrasion and inhibits foreign matter from entering the casing of the noncontaminative centrifugal pump.

BACKGROUND ART

Generally, in a centrifugal pump for pumping pure water or the like, the entire wetted surfaces of the component parts are finished by grinding to increase impurity eliminating accuracy, and the component parts are formed of materials of an appropriate grade to prevent ionization. However, as regards the shaft seal assembly, a rotating ring is pressed with a spring against a fixed ring in sliding contact, tolerating the production of particles by abrasion as a natural result, and efforts have been entirely devoted to eject the particles produced by abrasion from the system. Although research on materials for forming abrasion-resistant surfaces are made, such materials are expensive and there is little prospect of successfully constructing a noncontaminative pump using such expensive materials.

Such a prior art centrifugal pump has been satisfactorily employed in the field where a liquid of a purity of: a comparatively low level is used. However, the prior art centrifugal pump is unsatisfactory for use in a system that handles a liquid of a very high purity, such as an ultrapure water system, and unsolved problems still reside therein.

It is an object of the present invention to provide a centrifugal pump of an ordinary, simple construction, eliminating plays in bearings by using a hydraulic thrust produced by the pressure produced by an impeller, provided with a shaft seal assembly forming a gap of an adjusted size between slipping surfaces, facilitating maintenance and inspection and conforming to requirements for pumping a high-purity liquid.

DISCLOSURE OF THE INVENTION

The present invention provides a noncontaminative centrifugal pump for pumping a high-purity liquid, such as a high-purity chemical or ultrapure water used in VLSI circuit manufacturing systems without producing any trace of dust. A pump in accordance with the present invention comprises a casing 1, a rotor comprising an impeller 5 and a main shaft 6, and a shaft seal assembly disposed in a portion of the casing 1 through which the main shaft penetrates the casing 1 and comprising a rotating ring 8*a* that rotates together with the rotor, and a fixed ring 8*b* disposed fixedly opposite to the rotating ring 8*a*. The fixed ring 8*b* is fixed to a seal case 9, and the seal case 9 is fitted in a boss of the casing 1 and connected to the casing 1 by screw thread engagement or the like so as to be movable relative to the casing 1 for positional adjustment to adjust the size of a gap e between the slipping surfaces properly without disassembling the pump while the pump is in operation as well as while the pump is stopped and to be fixed after positional adjustment.

The impeller 5 has main impeller vanes 5*a* for applying pressure to the liquid with centrifugal force, and outvanes 5*b* for counterbalancing an axial thrust generated by the produced pressure and acting on the impeller 5. The outside diameter and the shape of the outvanes 5*b* are designed so that an axial thrust acts in one direction on the impeller 5. This axial thrust biases the main shaft 6 in one direction to remove a play attributable to clearances between the components of a bearing 12, such as a ball bearing, and holds the main shaft 6 stably at an appropriate position to secure stably the gap e between the respective slipping surfaces of the rotating ring 8*a* and the fixed ring 8*b* in an appropriate size. The position of the seal case 9 is adjusted properly so that the sliding surfaces are not in contact with each other and an appropriate leakage is secured. Therefore, the shaft seal assembly does not produce any dust by abrasion, and any foreign matters are not admitted into the pump, whereby the quality of high-purity liquid is maintained. Naturally, the wetted components including the casing 1 and the impeller 5 are finished properly for impurity removal by conventional finishing techniques including precision machining, mirror-finish polishing and supercleaning.

BEST MODE FOR CARRYING OUT THE INVENTION

A mechanical seal assembly, i.e., a conventional shaft seal assembly employed in pumps of the type pertaining to the present invention has a rotating ring and a fixed ring pressed against each other with a spring in sliding contact for sealing. The present invention, differing in technical idea from such a conventional mechanism, forms a gap between the slipping surfaces of a rotating ring and a fixed ring to keep the rotating ring and the fixed ring separated from each other and to allow a controlled leakage through the gap, so that no dust is produced by abrasion, external impurities are inhibited from entering the casing and the liquid is maintained in a high-purity liquid condition.

Figure 3:
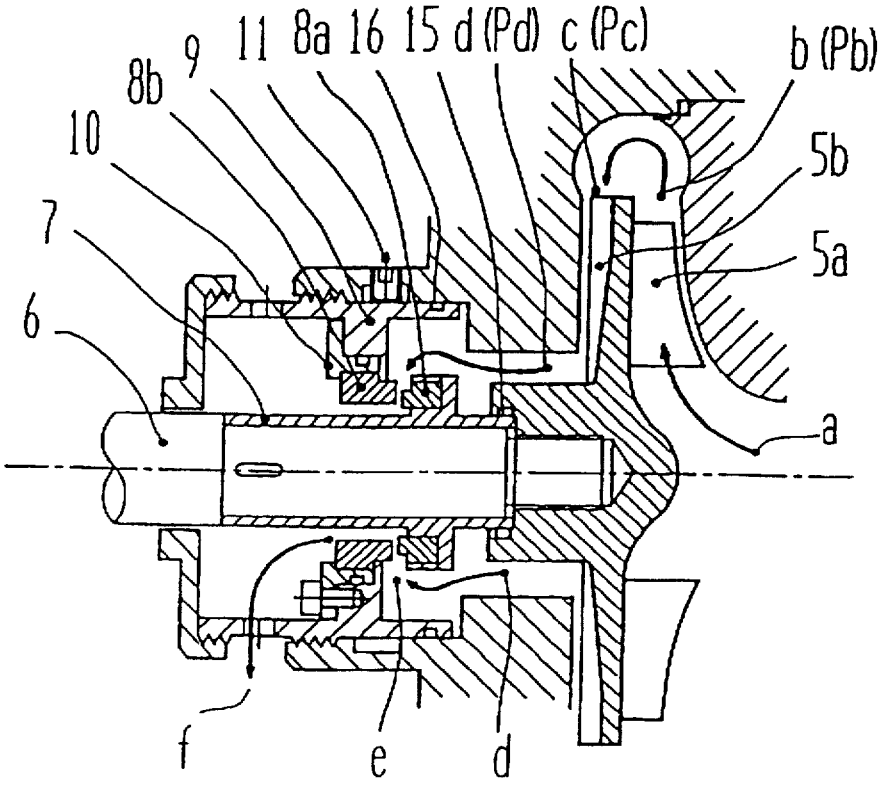
FIG. 3 is a fragmentary longitudinal sectional view showing a shaft seal assembly and flows of a liquid generated by an impeller included in the noncontaminative centrifugal pump.

Referring to FIG. 3, upon start of operation of a noncontaminative centrifugal pump after adjusting the position of a seal case 9 so that a gap e of a set size is formed between the slipping surfaces of a rotating ring 8*a* and a fixed ring 8*b*, a small flow (leakage) is produced from a suction opening a through the circumference b of an impeller 5, the back side c of the impeller 5, a central portion d of the back side of the impeller 5 and the gap e to a recovery line f when a pumping flow is produced from the suction opening a through the circumference b of the impeller 5 to the discharge opening, not shown. A portion of the liquid of a pressure Pb flowing along the circumference of the impeller 5 flows along the back side c of the impeller 5 against a centrifugal force toward the central portion d of the back side c of the impeller 5, and the pressure of the portion of the liquid decreases to a pressure Pd. The portion of the liquid of the pressure Pd leaks through the gap e and is discharged to the outside of the system through the recovery line f.

A main shaft 6 can be positioned with a certain accuracy by the conventional technique that limits clearances between the components of a bearing 12, such as a ball bearing, by preloading the bearing 12. According to the present invention, the pressure difference between the pressure Pb prevailing around the circumference b of the impeller 5 and a pressure Pc prevailing in the vicinity of the back side c of the impeller 5 by outvanes **5*b* acts as a hydraulic axial thrust to the left, as viewed in FIG. 3, on the main shaft 6 to inhibit the play of the main shaft 6 attributable to the clearances between the components of the bearing 12 supporting the main shaft 6 and, consequently, the axial position of the main shaft 6 can be very accurately stabilized, so that the appropriate size of the gap e between the rotating ring 8*a* and the fixed ring 8*b*** can be stably secured.

The size of the gap e can be adjusted during the operation of the noncontaminative centrifugal pump. The leakage through the gap e is monitored through observation of the flow of the liquid through the recovery line f, the axial position of a seal case 9 is adjusted without stopping the noncontaminative centrifugal pump so that a set leakage is secured, and then the seal case 9 is fixed relative to a casing 1 with a set screw 11.

Figure 1:
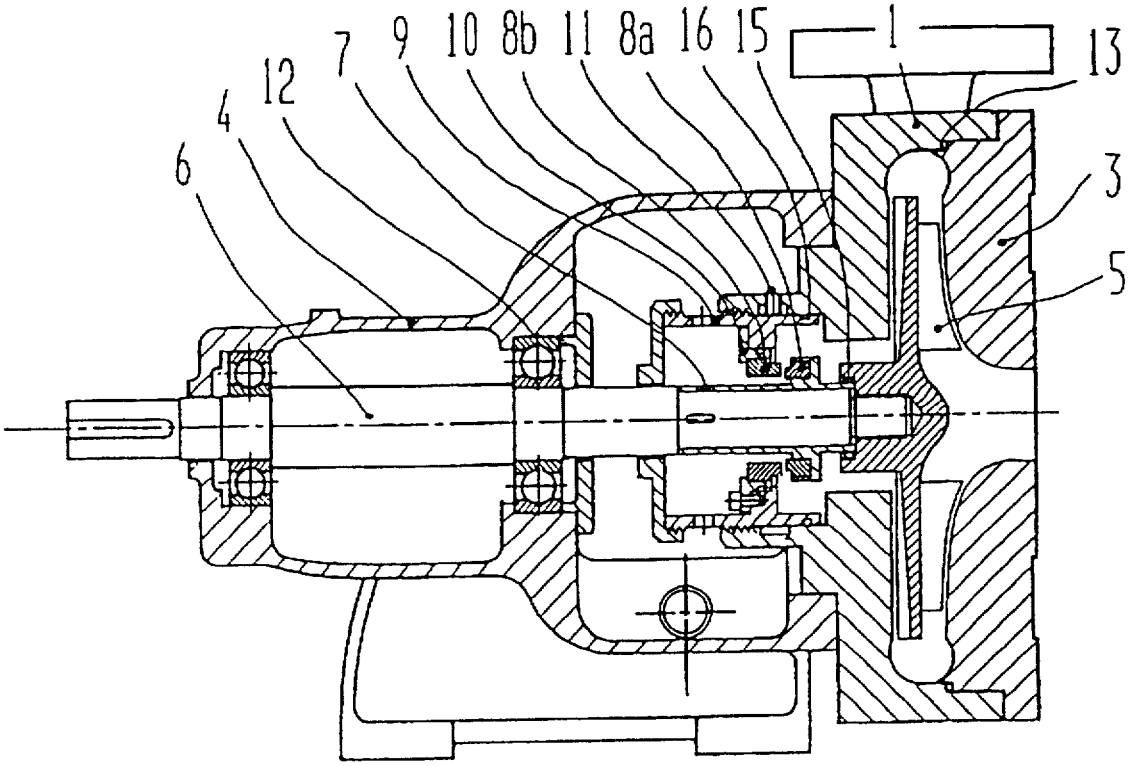
FIG. 1 is a longitudinal sectional view of a noncontaminative centrifugal pump of a preferred embodiment according to the present invention.

A preferred embodiment of the present invention will be described in detail with reference to the accompanying drawings. FIG. 1 is a longitudinal sectional view of a noncontaminative centrifugal pump of a preferred embodiment according to the present invention, showing a casing 1, a series of stationary parts including a bearing support 4, a rotor comprising a main shaft 6 and an impeller 5 mounted on the main shaft 6, and a rotating ring **8*a* of a shaft seal assembly disposed on the side of the liquid with respect to the fixing ring 8*b***.

Figure 2:
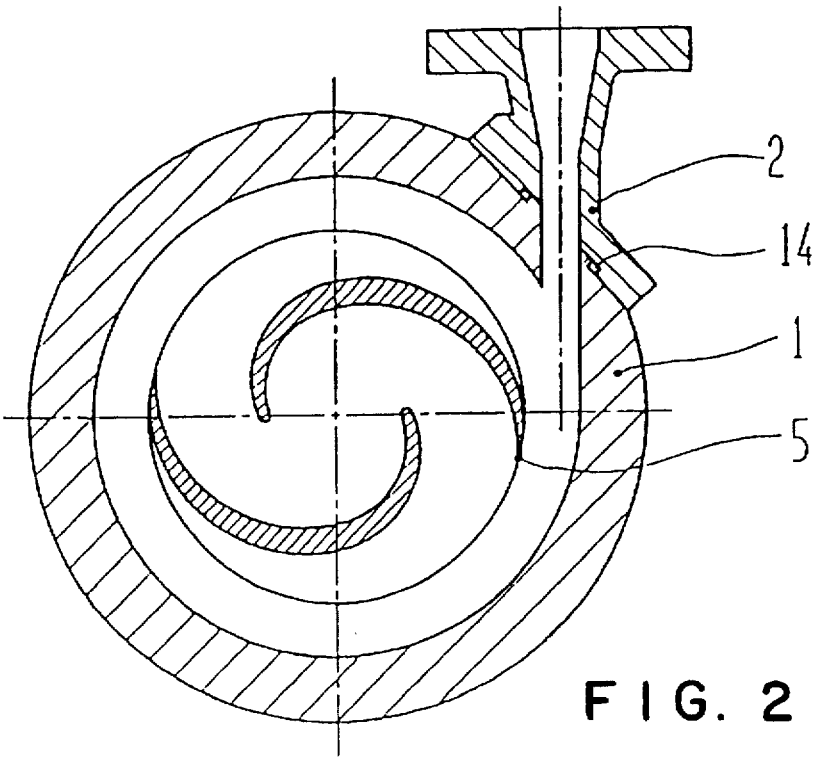
FIG. 2 is a cross-sectional view of an impeller section of the noncontaminative centrifugal pump, as viewed from the suction side.

FIG. 2 shows the casing 1 and the impeller 5 of the noncontaminative centrifugal pump embodying the present invention. The wetted component parts are designed in shapes capable of being precisely finished by turning or the like. For example, the impeller 5 is of a semiopen type and portions of the volute casing 1 are formed in concentric circular shapes, respectively, and are entirely subjected to mirror-finish grinding (electropolishing), etc. and super-cleaning. The noncontaminative centrifugal pump is designed so that pockets in which the liquid stagnates are reduced to the least possible extent. A discharge pipe 2 is formed separately from the casing 1 to enable the perfect grinding of a discharge diffusing portion, which is narrow when the noncontaminative centrifugal pump is of a small capacity. The discharge pipe 2 is finished by grinding and is fastened to the casing 1 with an O-ring 14 disposed between the casing 1 and the discharge pipe 2 for sealing. Thus, the discharge pipe 2 can be removed from the casing for cleaning.

FIG. 3 shows the details of a shaft seal assembly and flows of the liquid produced by the impeller 5. The fixed ring **8*b* is fastened to the seal case 9 with a holding member 10, the seal case 9 is held in the casing 1 in screw engagement with an O-ring 16 between case 9 and casing 1. The seal case 9** is moved axially for fine positional adjustment to form a gap e of an optimum size for a set leakage.

The outvanes **5*b* of the impeller 5 are designed so that an axial thrust acts to the left, as viewed in FIG. 3, on the main shaft 6. When the noncontaminative centrifugal pump operates, the main shaft 6 is shifted to the left, as viewed in FIG. 3, and the size of the gap e in a stationary state is reduced to an appropriate size so that the leakage is adjusted properly to the least necessary value. When the noncontaminative centrifugal pump is stopped, the size of the gap e increases slightly and the leakage increases slightly, which is desirable for the purpose of inhibiting foreign matters from entering the noncontaminative centrifugal pump. However, when increase in the leakage needs to be suppressed, it is possible to limit the leakage to a desired value while the noncontaminative centrifugal pump is stopped by a conventional technique, for example, by providing the pumping system with an automatic regulating valve in connection with the noncontaminative centrifugal pump. The outvanes 5*b* may be designed, when required, so that an axial thrust that acts to the right on the main shaft 6** is produced. When the axial thrust acts to the right, the leakage is limited to the least value while the noncontaminative centrifugal pump is stopped and the leakage increases slightly when the noncontaminative centrifugal pump operates.

Figure 4:
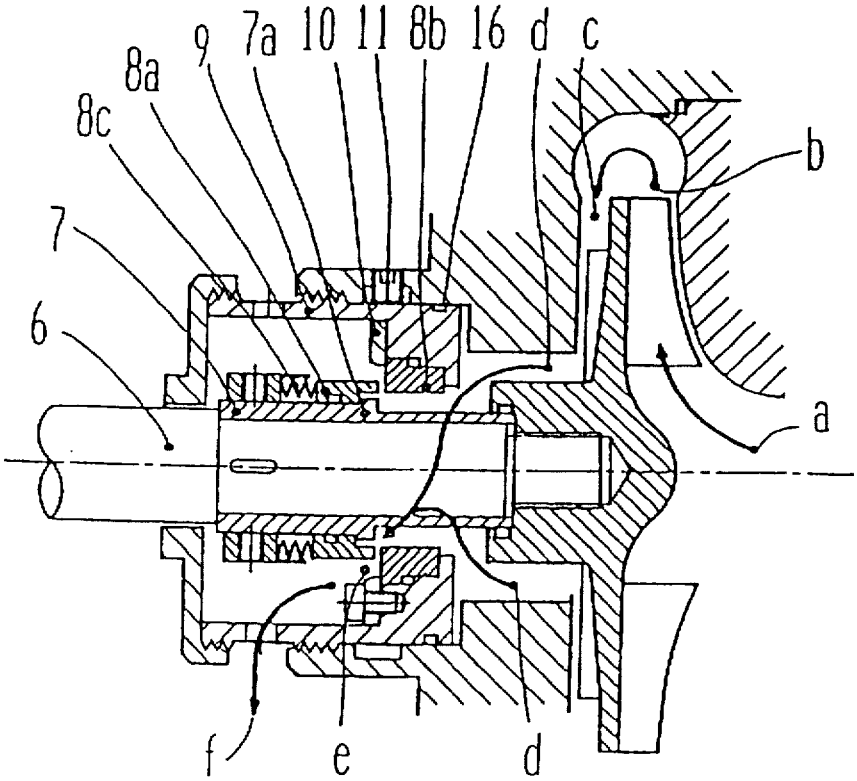
FIG. 4 is a fragmentary longitudinal sectional view of a modification of the noncontaminative centrifugal pump of FIG. 1, in which a rotating ring is disposed on the side of the atmosphere with respect to a fixed ring.

FIG. 4 shows a noncontaminative centrifugal pump of another embodiment according to the present invention, in which a rotating ring **8*a* is disposed on the side of the atmosphere with respect to a fixed ring 8*b*, and the components are designed so that an axial thrust acting to the right is produced when the noncontaminative centrifugal pump operates. The effects of the disposition of the rotating ring 8*a* on the side of the atmosphere with respect to the fixed ring 8*b* is the same as that of the rotating ring 8*a* on the side of the liquid with respect to the fixed ring 8*b* as shown in FIG. 3, and the direction of action of the axial thrust may be altered. The rotating ring 8*a* is mounted on a sleeve 7 provided with a shoulder 7*a* and is pressed against the shoulder 7*a* with a spring 8*c* to prevent abnormal contact between the slipping surfaces of the rotating ring 8*a* and the fixed ring 8*b* due to an erroneous operation for adjusting the position of a seal case 9 and to inhibit wobbling motion of the rotating ring 8*a***.

Although an impeller 5 is fixed directly to a main shaft 6 with an O-ring 15 therebetween by screwing the impeller 5 on the main shaft 6 in these embodiments shown in FIGS. 3 and 4, the impeller 5 may of course be keyed to the main shaft 6 to transmit the torque of the main shaft to the impeller 5 and may be fixed to the main shaft 6 with a nut.

The shapes and the materials of the rotating ring **8*a* and the fixed ring 8*b* may be optionally selected according to the purpose of the noncontaminative centrifugal pump, provided that the respective slipping surfaces of the rotating ring 8*a* and the fixed ring 8*b* can be accurately machined and finished. Naturally, the members of a general mechanical seals may be applied to the rotating ring 8*a* and the fixed ring 8*b*. The sleeve 7 may be omitted and the rotating ring 8*a* may be mounted directly on the main shaft 6**. It is to be understood that the present invention may be practiced otherwise than as specifically described herein without departing from the scope and spirit thereof.

INDUSTRIAL APPLICABILITY

As is apparent from the foregoing description, the noncontaminative centrifugal pump in accordance with the present invention has a simple construction, can be manufactured at comparatively low manufacturing costs, facilitates work for inspection, adjustment and so on, the rotating ring and the fixed ring of the shaft seal assembly are held in a noncontact state with a gap therebetween to allow a set leakage through the gap outside therefrom, does not produce any dust therein, inhibits foreign matters from entering therein and is capable of insuring the high-purity quality of the liquid. Thus, the noncontaminative centrifugal pump of the present invention can be effectively applied to pumping a high-purity liquid, such as high-purity chemicals, and ultrapure water for use on a VLSI circuit manufacturing line.

What is claimed is:

1. A non contaminative centrifugal pump for pumping a high purity liquid, comprising:

a casing;

a rotatable main shaft extending through said casing;

a shaft seal assembly between said casing and said main shaft, said shaft seal assembly including a rotating ring mounted on said main shaft and a fixed ring mounted on said casing, said rotating ring and said fixed ring being disposed to be separated from one another, axially of said main shaft, to define therebetween a gap which is maintained both during operation and stoppage of the pump to allow liquid to leak through the gap and outside the pump even during the operation of the pump;

rolling bearing means rotatably supporting said main shaft and having therein an inherent small clearance which is absorbed when the main shaft is shifted in an axial direction thereof; and an impeller fixedly mounted on said main shaft and having a configuration to exert a hydraulic thrust force against said main shaft and bias said main shaft in axial direction when the pump is in operation, thereby to shift said main shaft and said rotating ring in said axial direction by a distance corresponding to said clearance and thereby to fix said main shaft in said axial direction, so that said gap is set at an exact predetermined value during the operation of the pump to allow a predetermined amount of leakage of the liquid through said gap to the outside of the pump and thereby prevent generation of dust by abrasion of said rotating and said fixed rings and also inhibit entry of foreign matter into said casing.

2. A noncontaminative centrifugal pump according to claim 1, wherein said fixed ring is mounted to be shiftable axially of said main shaft relative to said casing for fine positional adjustment of said gap.

3. A noncontaminative centrifugal pump according to claim 2, comprising a structure on which said fixed ring is mounted on said casing, said structure being shiftable relative to said casing and axially of said main shaft for fine adjustment.

4. A noncontaminative centrifugal pump according to claim 1, wherein said rotating ring is disposed between said impeller and said fixed ring, and said impeller is configured to exert said hydraulic thrust force toward said fixed ring.

5. A noncontaminative centrifugal pump according to claim 1, wherein said rotating ring is disposed between said impeller and said fixed ring, and said impeller is configured to exert said hydraulic thrust force away from said fixed ring.

6. A noncontaminative centrifugal pump according to claim 1, wherein said fixed ring is disposed between said impeller and said rotating ring, and said impeller is configured to exert said hydraulic thrust force away from said fixed ring.

7. A noncontaminative centrifugal pump according to claim 1, wherein said fixed ring is disposed between said impeller and said rotating ring, and said impeller is configured to exert said hydraulic thrust force toward said fixed ring.

8. A noncontaminative centrifugal pump according to claim 1, wherein said rotating ring is supported on said main shaft so as to be shiftable axially of the main shaft against a resilient force.

9. A noncontaminative centrifugal pump according to claim 1, wherein said rolling bearing means limits the axial displacement of said main shaft and said rotating ring, due to said hydraulic thrust, to said small clearance in the rolling bearing means to prevent further axial displacement of said rotating ring towards said fixed ring and preserve said exact predetermined value of said gap during the operation of said pump.

10. A noncontaminative centrifugal pump for pumping a high purity liquid, comprising:

a casing;

a rotatable main shaft extending through said casing;

a shaft seal assembly between said casing and said main shaft, said shaft seal assembly including a rotating ring mounted on said main shaft and a fixed ring supported by said casing with capability of fine positional adjustment in axial directions of said main shaft, said rotating ring and said fixed ring being disposed to be separated from one another, axially of said main shaft, to define therebetween a gap which is maintained both during operation and stoppage of the pump to allow liquid to leak through the gap and outside the pump even during the operation of the pump;

rolling bearing means rotatably supporting said main shaft and having therein an inherent small clearance in axial direction of the shaft which is absorbed when the main shaft is shifted in an axial direction thereof; and an impeller fixedly mounted on said main shaft and having a configuration to exert a hydraulic thrust force against said main shaft and bias said main shaft in said axial direction when the pump is in operation, thereby to shift said main shaft and said rotating ring in said axial direction by a distance corresponding to said clearance in said rolling bearing means and thereby to maintain said main shaft immovable in said axial direction, so that said gap is set at an exact predetermined value during the operation of the pump to allow a predetermined amount of leakage of the liquid through said gap to the outside of the pump and thereby prevent generation of dust by abrasion of said rotating and said fixed rings and also inhibit entry of foreign matter into said casing.

11. A noncontaminative centrifugal pump according to claim 10, comprising a positional adjustment structure through which said fixed ring is supported on said casing, said positional adjustment structure being mounted on said casing for adjusting the fixed ring with respect to said axial direction of the main shaft.

12. A noncontaminative centrifugal pump according to claim 11, wherein said positional adjustment structure comprises a seal case which fixedly secures said fixed ring thereon and is in screw engagement with said casing for effecting said fine positional adjustment in the axial directions of the main shaft.

13. A noncontaminative centrifugal pump according to claim 12, wherein said seal case is screw adjustable, from outside, relative to said casing.

14. A noncontaminative centrifugal pump for pumping a high purity liquid, comprising:

a casing;

a rotatable main shaft extending through said casing;

bearing means rotatably supporting said main shaft;

a shaft seal assembly between said casing and said main shaft, said shaft seal assembly including a rotating ring mounted on said main shaft and a fixed ring supported by said casing, said rotating ring and said fixed ring being disposed to be separated from one another, axially of said main shaft, to define therebetween an axial gap which is maintained both during operation and stoppage of the pump to allow liquid to leak through the gap and outside the pump even during the operation of the pump; and adjusting means interposed between said fixed ring and said casing for fine positional adjustment of the fixed ring relative to said casing in axial directions of said main shaft;

whereby said axial gap is set at a predetermined value during both operation and stoppage of the pump to allow a predetermined amount of leakage of the liquid through said gap to the outside of the pump and thereby prevent generation of dust by abrasion of said rotating and said fixed rings and also inhibit entry of foreign matter into said casing.

15. A noncontaminative centrifugal pump according to claim 14, wherein said adjusting means comprises a seal case which fixedly secures said fixed ring thereon and is in screw engagement with said casing for fine positional adjustment in said axial directions of the main shaft.

16. A noncontaminative centrifugal pump according to claim 15, wherein said seal case is screw adjustable from outside relative to said casing.

* * * * *